United States Patent [19]

Lahti et al.

[11] Patent Number: 4,590,348

[45] Date of Patent: May 20, 1986

[54] SYSTEM FOR HEATING MATERIALS WITH ELECTROMAGNETIC WAVES

[75] Inventors: Howard R. Lahti, Mattawa; Wallace R. Lahti, Pefferlaw, both of Canada

[73] Assignee: Canadian Patents and Development Limited, Ottawa, Canada

[21] Appl. No.: 632,515

[22] Filed: Jul. 19, 1984

[30] Foreign Application Priority Data

Jul. 20, 1983 [CA] Canada ..... 432797

[51] Int. Cl.[4] ..... H05B 6/80; E21C 37/16

[52] U.S. Cl. ..... 219/10.55 M; 219/10.55 A; 219/10.55 B; 299/3; 299/6; 299/14; 405/131

[58] Field of Search ..... 219/10.55 A, 10.55 B, 219/10.55 R, 10.55 M, 10.55 F, 10.57; 405/131; 299/3, 6, 14

[56] References Cited

U.S. PATENT DOCUMENTS

| | | | |
|---|---|---|---|
| 3,230,957 | 2/1961 | Seifert | 219/10.55 R |
| 3,263,052 | 7/1966 | Jeppson et al. | 219/10.55 A |
| 3,829,649 | 8/1974 | Igarashi | 219/10.55 B |
| 3,980,855 | 9/1976 | Boudouris et al. | 219/10.55 A |
| 3,988,036 | 10/1976 | Fisher et al. | 299/6 X |
| 4,208,562 | 6/1980 | Perreault | 219/10.55 R |
| 4,217,477 | 8/1980 | Matsubara et al. | 219/10.55 B |
| 4,221,948 | 9/1980 | Jean | 219/10.55 A |
| 4,256,944 | 3/1981 | Brandon | 219/10.55 A |
| 4,370,534 | 1/1983 | Brandon | 219/10.55 A |
| 4,370,535 | 1/1983 | Noda | 219/10.55 B |
| 4,399,341 | 8/1983 | Yasuoka | 219/10.55 R |

FOREIGN PATENT DOCUMENTS

| | | | |
|---|---|---|---|
| 1044331 | 12/1978 | Canada | 219/10.55 F |
| 927901 | 5/1982 | U.S.S.R. | 405/131 |

OTHER PUBLICATIONS

"Review of Thawtron TM Device for Thawing Frozen Coal," Mar. 1982, Prepared by SRI Intl., Menlo Park, CA; Principal Investigators W. A. Edson and G. E. Tallmadge.

*Primary Examiner*—Philip H. Leung

*Attorney, Agent, or Firm*—Jones, Tullar & Cooper

[57] ABSTRACT

A system for controlling microwave heaters in order to efficiently heat frozen ground. The heaters are energized and deenergized by a control unit in response to the temperature sensed a selected distance from a heater. The control unit also deenergizes the heater in response to a temperature sensed in the vicinity of the applicators of the heater in order to protect the heaters from overheating.

11 Claims, 2 Drawing Figures

SYSTEM FOR HEATING MATERIALS WITH ELECTROMAGNETIC WAVES

BACKGROUND OF THE INVENTION

1. Field of the Invention

This invention relates to a method and apparatus for heating materials with electromagnetic waves, and more particularly, to a control system for electromagnetic heaters. The invention has particular application to the thawing of frozen ground.

Every winter, construction is greatly hindered by frozen ground conditions. Machines presently available for winter excavation are expensive to purchase, expensive to operate and are cumbersome. These machines cannot navigate along complicated trenchlines. Repair work to underground cables and water or gas lines during winter requires the use of jack-hammer and manual labour to excavate the ground around the damaged section. In result, excavation, if attempted when the ground is frozen, results in additional expenses.

2. Description of Related Art

C.P. No. 1,044,331 issued Dec. 12, 1978 to Hamid discloses a microwave horn applicator for use in thawing frozen ground. The applicator is placed on the surface of the ground and radiates energy into the soil. The disclosed apparatus suffers two drawbacks. Firstly, an individual using such apparatus must periodically deactivate the microwave generator and check the depth of penetration of the applicator by manual means to determine whether thawing is complete. Secondly, the applicator itself could overheat and thereby be damaged.

It is also known to insert a waveguide applicator in a material for radiating microwaves into the material in order to heat it—see, for example, U.S. Pat. No. 4,370,534 issued Jan. 25, 1983 to Brandon. However, the known apparatus lacks means to directly determine the extent of the heat treating and means to avoid overheating the applicator.

SUMMARY OF THE INVENTION

This invention seeks to provide apparatus which eliminates one or both of these drawbacks of the prior art apparatus and further, which more efficiently thaws frozen material with microwave energy.

Briefly stated, the present invention is an apparatus for heating materials comprising: (a) a plurality of electromagnetic wave applicators coupled to electromagnetic energy generator means; (b) means to sense the temperature of a material; (c) a control unit operatively connected to the electromagnetic energy generator means and the means to sense the temperature of a material; (d) means to activate the generator means; the control unit being for the purpose of deactivating the generator means whenever the means to sense the temperature of a material senses a temperature greater than a predetermined temperature.

Briefly stated, the present invention is also a process for heating material with electromagnetic energy through applicators positioned so as to radiate the energy into the material, comprising the steps of: (a) sensing the temperature of the material a selected distance from at least one of the applicators; (b) commencing to radiate electromagnetic energy through the applicators whenever the sensed temperature falls below a first predetermined temperature; (c) ceasing to radiate electromagnetic energy through the applicators whenever the sensed temperature rises above a second predetermined temperature, the second predetermined temperature being at least as high as the first predetermined temperature.

BRIEF DESCRIPTION OF THE DRAWINGS

In the figures which illustrate an embodiment of this invention.

DESCRIPTION OF THE PREFERRED EMBODIMENTS

Figure 1:
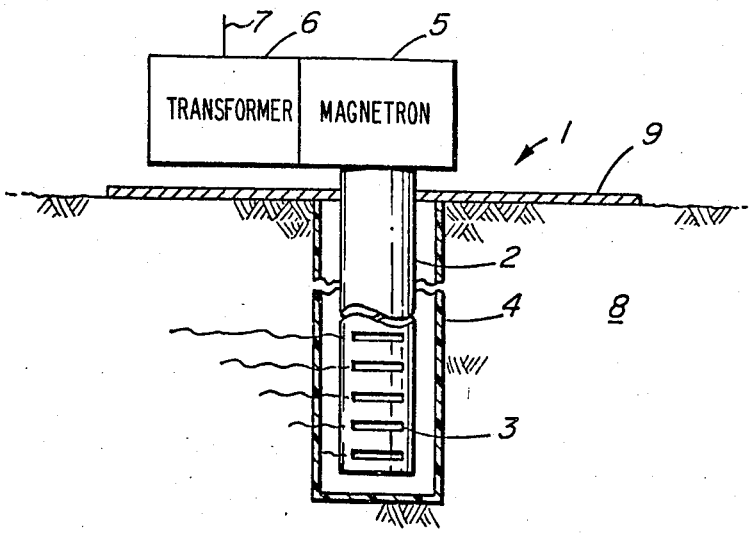
FIG. 1 is a schematic view of a microwave heater for use in the system of the present invention.

Turning now to FIG. 1, 1 designates generally a microwave heater suitable for use in the system of the present invention. The heater comprises an elongated cylindrical applicator 2 of about 1 meter in length which is shown inserted in frozen ground 8. The applicator is an antenna provided with apertures 3 for radiating microwave energy. The distribution of the apertures is such that the highest concentration of energy is transmitted near the end of the applicator which is nearest the ground surface. The distribution is also such that there is zero, or near zero transmission of energy at the other end of the applicator. This end will be, in most cases, in contact with unfrozen ground as the temperature of frozen ground increases with depth. A low-loss heat resistant liner 4 may surround the antenna in order to prevent material from entering apertures 3. Optionally, air may be circulated through the antenna for cooling purposes. A suitable cylindrical applicator is described in greater detail in copending application Ser. No. 620,669 filed June 14, 1984.

The applicator is connected to a magnetron 5 capable of developing 1,300 watts power at 2,450 MHz. Preferably the connection facilitates quick coupling and decoupling. The magnetron is connected to a transformer 6 which is fed from a 110 V AC power supply by means of electrical cord 7. An insulating mat 9 may be laid over the applicator to protect the ground from excessive heat loss. Magnetrons are typically 60% efficient. To improve the efficiency of the applicator, the exhaust from the cooling fan of the magnetron can be directed underneath the insulating mat.

Figure 2:
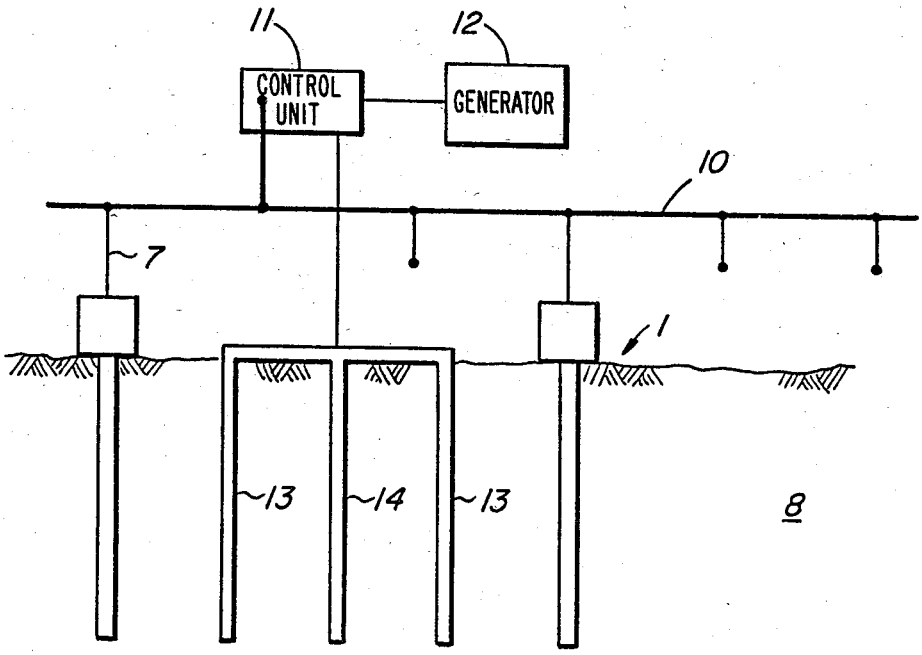
FIG. 2 is a schematic view of an embodiment of the system of this invention.

FIG. 2 illustrates the system of this invention adapted to facilitate excavation of a trench. The applicators of a plurality of microwave heaters are inserted into previously provided holes in the frozen ground 8. Such holes may be drilled and are uniformly distributed over the entire rectangular area to be heated. Electrical cords 7, connected in parallel to primary power harness 10, are connected to the transformer of each heater. The power harness is selectively connected to portable diesel generator 12 through control unit 11.

Two temperature sensors 13 are inserted into previously provided holes in the frozen ground in the vicinity of the applicators of two microwave heaters. A master temperature sensor 14 is inserted into a previously provided hole located at a point a selected distance from the applicator of a heater in the area to be heated. All three temperature sensors may be inserted to one half the depth of the applicators. Alternatively, each sensor may comprise three sensors, the middle sensor being inserted to one half the depth of the applicator and being bracketed by two sensors, one at a shallow depth near the surface of the ground, and the other at the depth of the applicators. All temperature sensors are connected to control unit 11 so that the value of the temperatures they detect are supplied to the control unit. The temperature sensors may be thermistors or thermometers.

The control unit may be set to automatic or manual mode. When set to manual, the power harness may be manually switched into the generator feed line. When set to automatic, the control unit automatically controls the switching, energizing and deenergizing the heaters in response to temperatures sensed by sensors 13 and 14. In this way, as is described in more detail hereinafter, a known portion of the ground to be excavated is thawed without overheating the applicators.

Once activated and set to automatic, control unit 11 reads the temperature sensed by temperature sensor 14. The control unit compares the temperature sensed with two temperature values preset by the operator. If the sensed temperature is less than the first preset temperature, the control unit, subject to its response to the temperature sensed by temperature sensor 13 which response is described hereinafter, energizes the heaters. If the sensed temperature is greater than the second preset temperature, the control unit deenergizes the heaters.

If temperature sensor 14 comprises three sensors, then the control unit, again subject to its response to sensors 13, will energize the heaters if any of the three sensed temperatures is less than the first preset temperature. Similarly, if any of the three sensed temperatures is greater than the second preset temperature the control unit deenergizes the heaters.

The second preset temperature should be in the range of 0° C. to 1° C. so that the ground will have thawed, or be on the verge of thawing, in the vicinity of temperature sensor 14 when the heaters are deenergized in response to the sensor. 0° C. is a satisfactory temperature as at this temperature and before ice melts a large drop in the shear strength of the ice-soil mixture occurs.

It will be realized that upon sensor 14 detecting the second preset temperature, the ground between sensor 14 and the closest heater thereto will have attained a temperature greater than the second preset temperature. Indeed, at a distance of 2 to 3 centimeters from the applicator, the temperature may exceed 100° C. Further, the ground on the side of sensor 14 remote from the closest heater will have attained a temperature less than the second predetermined temperature, however, such ground will continue to heat after the heaters are deenergized as the energy in the ground equilibrates.

The first preset temperature is selected so that heating will commence if the ground in the vicinity of sensor 14 is frozen. In addition, this temperature is set so that once the second preset temperature is reached the ground between sensor 14 and the closest applicator will not refreeze prior to excavation. Consequently, this first preset temperature may be 0.4° to 1.0° C. less than the second preset temperature, but in no case less than 0° C. The control unit may be set to energize the heaters at a lower power level after the temperature has risen above the second preset temperature and subsequently fallen below the first preset temperature, as less energy is necessary to prevent the ground from refreezing than is necessary to thaw it.

In an alternative embodiment, only one temperature is preset by the operator. In this embodiment, once the control unit is actuated and set to automatic it, subject to its response to temperature sensors 13, energizes the heaters if the temperature sensed by sensor 14 is less than the preset temperature and deenergizes the heaters when the sensed temperature rises above this preset temperature. Subsequently, the control unit will not respond to the temperature sensed by sensor 14, but instead intermittently energizes the applicators in response to intervals signalled by a timer. The timer is preset to signal intervals of selected duration which are selected times apart. The selected duration and times apart are chosen so as to approximate the pulsed energy necessary to maintain the ground in an unfrozen state until excavation starts.

It is not necessary to thaw the entire area to be excavated in order to be able use standard construction equipment for excavation. In fact, a backhoe is able to excavate soil in which volumes of soil, not exceeding about 10–15 centimeters in surface area, remain frozen. Thus, the microwave heaters need only thaw a portion of the frozen ground and may leave volumes frozen which do not exceed a certain size. The distance selected between temperature sensor 14 and a heater permits this operation.

In operation, each microwave heater, with time, thaws a progressively larger volume of soil. If the heaters are uniformly distributed over the area to be excavated and each heater produces similar radiation patterns, then the distance between temperature sensor 14 and the closest heater thereto will determine the surface area of the volumes of ground thawed and of the volumes which remain frozen. The distance between sensor 14 and the closest heater thereto may than be selected so that the heaters will not shut off in response to the temperature sensed by sensor 14 until the maximum dimension of the surface area of each volume of frozen soil remaining is less than 10–15 centimeters. This "patch-work" thawing makes efficient use of the microwave heaters.

Temperature sensors 13 function to protect the microwave heaters from overheating. Two sensors 13 are provided adjacent two different heaters. The temperature sensed is supplied to control unit 10 which shuts down the system whenever the temperature rises above a preset level. The preset level is selected to represent a condition of overheating. The control unit will again activate and deactivate the heaters in response to temperature sensor 14 when the temperature sensed by sensors 13 fall to another preset temperature which represents normal operating temperature.

In order to further protect against overheating, air may be circulated through the applicators to cool them.

A light may be located on the heaters to provide an optical safety sign that they are operating.

As will be obvious to those skilled in the art, the system of the present invention, though particularly adapted for use with microwave applicators which are inserted in a material to be heated, may also be used with applicators placed on the surface of the material.

The present invention also clearly has application to heating materials other than frozen ground. For example, the system may be used to thaw sand that is to be used for sanding highways in the winter. This would reduce or eliminate the necessity of mixing sand with salt. Further, the invention could be employed to protect poured footing foundations in the winter by maintaining the ground at 0° C. until the cement has set and back-filling has been completed.

We claim:

1. A process for preparing frozen material for excavation comprising the steps of:

(a) inserting longitudinally elongate electromagnetic energy applicators into said material at spaced locations, each said applicator being constructed for radiation of electromagnetic energy along a substantial portion of its length;

(b) sensing the temperature of said material a selected distance from at least one applicator;

(c) radiating electromagnetic energy through said applicators;

(d) ceasing to radiate electromagnetic energy through said applicators when said sensed temperature reaches a predetermined temperature, said predetermined temperature being at about the freezing point of said material, said selected distance being chosen so that portions of said material are heated to their freezing point and other portions of said material remain substantially unheated by said electromagnetic energy.

2. The process of claim 1 wherein said predetermined temperature is 0° centigrade.

3. The process of claim 1 including the step of:

(e) thereafter intermittently radiating electromagnetic energy through said applicators to maintain portions of said material at their freezing point.

4. A process for preparing frozen material for excavation comprising the steps of:

(a) inserting longitudinally elongate electromagnetic energy applicators into said material such that adjacent applicators are spaced at least a first distance apart, each said applicator being constructed for radiation of electromagnetic energy along a substantial portion of its length;

(b) sensing the temperature of said material a second distance from at least one of said applicators, said second distance being less than one half of said first distance;

(c) initiating radiation of electromagnetic energy through said applicators when said sensed temperature falls below a predetermined temperature, said predetermined temperature being at about the freezing point of said material;

(d) interrupting radiation of electromagnetic energy through said applicators when said sensed temperature rises to a second predetermined temperature, said second predetermined temperature being at least as high as the freezing point of said material, so that portions of said material are heated to their freezing point, and other portions of said material are substantially unheated by said electromagnetic energy.

5. The process of claim 4 wherein said applicators comprise coaxial slotted antennas.

6. The process of claim 4 wherein said predetermined temperature is 0° centigrade.

7. The process of claim 4, including the step of:

(e) sensing the temperature in the vicinity of at lease one of said applicators and interrupting radiation of electromagnetic energy through said applicators while said temperature in the vicinity of at least one of said applicators exceeds a predetermined temperature indicative of the overheating of said applicators.

8. The process of claim 7, further including the step of:

intermittently activating and deactivating the radiation of electromagnetic energy through said applicators in response to a timer after said sensed temperature has risen to said second predetermined temperature to maintain said material at about said second predetermined temperature.

9. The process of claim 7, wherein the step of sensing the temperature of said material includes measuring the temperature at three different depths in said material, one measurement being taken at the surface, one at a depth of one-half the depth of said elongate applicators, and one at the full depth of said elongate applicators.

10. Apparatus for preparing frozen material for removal comprising:

(a) a plurality of cylindrical coaxial electromagnetic wave applicators slotted along a substantial portion of their length for insertion into said frozen material;

(b) electromagnetic energy generator means coupled to said applicators;

(c) at least one temperature sensor for insertion into said frozen material a selected distance from said applicators;

(d) first control means to initiate electromagnetic energy generation from said generator;

(e) second control means for interrupting electromagnetic energy generation from said generator when the temperature sensed by said temperature sensor exceeds a predetermined temperature, said selected distance being such that, when said apparatus is in operation, portions of said material remain frozen.

11. The apparatus of claim 10 wherein said first control means initiates electromagnetic energy generation when said temperature sensor senses a temperature below a second predetermined temperature.

* * * * *